United States Patent [19]

Guadagnino

[11] Patent Number: 4,706,842

[45] Date of Patent: Nov. 17, 1987

[54] APPARATUS FOR DISPENSING ELONGATED CYLINDRICAL OBJECTS SUCH AS PENCILS

[76] Inventor: Gus A. Guadagnino, 1539 Fayetteville, Spring Hill, Fla. 33526

[21] Appl. No.: 8,619

[22] Filed: Jan. 29, 1987

[51] Int. Cl.[4] ..... G07F 11/00; B65H 7/18

[52] U.S. Cl. ..... 221/14; 221/19; 221/187; 221/264; 221/238

[58] Field of Search ..... 221/13, 14, 18–20, 221/151, 152, 186, 187, 195, 196, 238, 175, 264, 293, 263

[56] References Cited

U.S. PATENT DOCUMENTS

| | | | |
|---|---|---|---|
| 1,297,775 | 3/1919 | Allen | 221/19 |
| 1,504,638 | 8/1924 | Mann, Jr. . | |
| 1,925,677 | 9/1933 | Richardson et al. | 221/18 |
| 2,873,012 | 2/1959 | Lux | 221/17 |
| 3,054,528 | 9/1962 | Loomis | 221/19 |
| 3,095,997 | 7/1963 | Garvin | 221/19 |
| 3,175,669 | 3/1965 | Garvin | 221/195 |
| 3,194,431 | 6/1962 | Garvin | 221/19 |
| 3,872,997 | 3/1975 | Armstrong et al. | 221/20 |
| 4,037,702 | 7/1977 | Albert | 221/17 |
| 4,084,724 | 3/1978 | Christophersen et al. | 221/20 |
| 4,085,863 | 4/1978 | Johnson | 221/20 |
| 4,189,044 | 2/1980 | Armstrong et al. | 221/19 |

*Primary Examiner*—H. Grant Skaggs
*Attorney, Agent, or Firm*—Pettis & McDonald

[57] ABSTRACT

Apparatus is disclosed for dispensing elongated cylindrical objects, such as pencils, and includes a housing, a hopper enclosed within the housing, actuating structure extending through a wall of the housing and engaging the hopper, a slide plate operatively connected to the hopper and actuating apparatus for carrying a single object to be dispensed to a dispensing position, and blocking apparatus having structure for sensing the presence or absence of an object to be dispensed carried by the slide plate and blocking movement of the slide plate and manual actuating structure if there is no object to be dispensed carried by the slide plate.

5 Claims, 8 Drawing Figures

APPARATUS FOR DISPENSING ELONGATED CYLINDRICAL OBJECTS SUCH AS PENCILS

BACKGROUND OF THE INVENTION

This invention relates to the field of dispensing apparatus. More specifically, it relates to the field of coin operated dispensing apparatus having means for preventing actuation of the dispensing apparatus if the objects to be dispensed have been exhausted.

Numerous types of apparatus have been developed for dispensing objects of almost every imaginable shape, size and composition. One particular type of dispensing apparatus is that capable of dispensing elongated cylindrical objects, such as pencils, which have a predetermined cylindrical axis. Examples of such vending machines are found in patents to Lux, U.S. Pat. No. 2,873,012, Loomis, U.S. Pat. No. 3,054,528 and Garvin, U.S. Pat. No. 3,095,997. While these prior art devices have met certain needs, the apparatus contained in those devices for stopping actuation of the dispensing apparatus upon exhaustion of the pencils or other objects to be dispensed has comprised a variety of complicated mechanisms utilizing pivots, levers and springs. Due to their complexity and the number of pivotally related components, these devices may become unreliable after a period of operation.

SUMMARY OF THE INVENTION

It is an object of the present invention to provide dispensing apparatus for elongated cylindrical objects that eliminates unreliable multipart linkages and spring assisted pivoting members. It is an additional object of the present invention to provide such an apparatus that provides for rugged and reliable operation. To achieve these and other objects that will become apparent to those skilled in the art, the present invention provides apparatus for dispensing elongated cylindrical objects, such as pencils, each having a predefined cylindrical axis, such apparatus including a housing, a hopper mechanism enclosed within the housing, manual actuating means operatively connected to the hopper mechanism for sliding movement thereof, a slide plate having an aperture for receiving an object to be dispensed and blocking apparatus supported by the housing and including apparatus for sensing the presence or absence of the object to be dispensed in the slide plate aperture and permitting movement of the slide plate if such an object is present in the aperture but blocking movement of the slide plate if such an object is absent. In this dispensing apparatus the housing includes a first support panel extending generally horizontally and having an aperture therethrough dimensioned to receive and pass through that aperture a single such object, a second support panel extending generally parallel to the first and having an aperture through such second support panel dimensioned to receive and pass such objects therethrough, and a delivery chute extending from adjacent the second support panel aperture to an outlet through at least one of the lateral side portions. The hopper is enclosed within the housing and is supported upon the first support panel for horizontal sliding movement between a first position and a second position, the hopper including side portions and a bottom portion with the bottom portion having an aperture therethrough for communicating with the first support panel aperture. The actuating mechanism extends through at least one of the lateral side portions and comprises an elongated member having one end adapted for grasping and movement by user of the dispensing apparatus and the other end operatively connected to the hopper for sliding movement of the hopper in a predetermined horizontal direction. The slide plate is supported upon the second support panel for horizontal movement thereover in the predetermined horizontal direction between a first position, in which the slide plate aperture is generally aligned with the first support panel aperture for receiving therethrough an object for dispensing, and a second position, in which the slide plate aperture is generally aligned with the second support panel aperture, the slide plate being operatively connected to the actuating mechanism for movement with the actuating mechanism. With this apparatus the slide plate, the hopper and the actuating mechanism may be moved from their respective first positions to their second positions only if an object to be dispensed is present in the slide plate aperture with the slide plate is at the first position.

BRIEF DESCRIPTION OF THE DRAWINGS

A particularly preferred embodiment of the dispensing apparatus of this invention will be described in detail below in connection with the illustrations in which.

DESCRIPTION OF A PREFERRED EMBODIMENT

Figure 1:
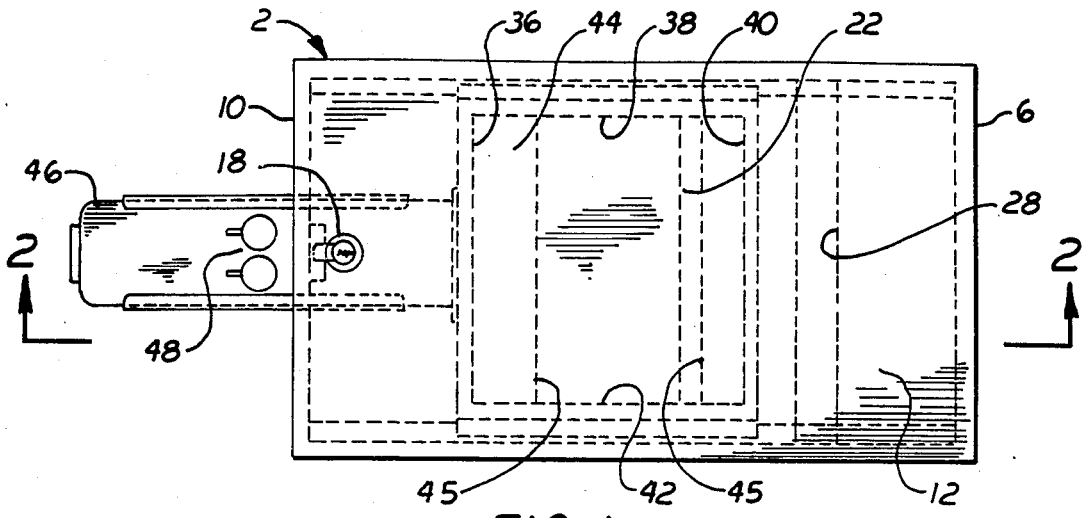
FIG. 1 is a top plan view of the dispensing apparatus.
Figure 2:
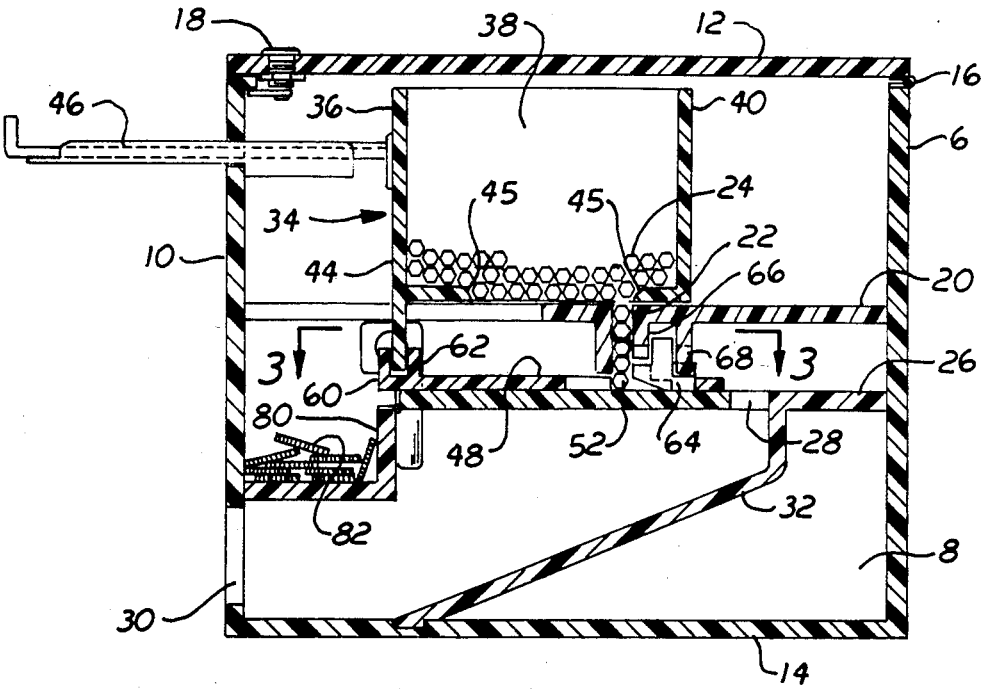
FIG. 2 is a side sectional view thereof, taken along line 2—2 of FIG. 1.

A preferred embodiment of the dispensing apparatus of this invention is illustrated in the top plan view and side sectional view of FIGS. 1 and 2, respectively. This apparatus includes housing means 2, which comprises lateral side portions 4, 6, 8 and 10, a top portion 12 and a bottom portion 14. Conveniently, the top portion 12 may be attached to the lateral side portion 6 by means of a hinge mechanism 16 and may be retained in its closed position by a suitable locking structure 18. Also included in the housing is a first support panel 20 extending generally horizontally and having an aperture 22 therethrough. This aperture 22 is dimensioned to receive and pass therethrough a single elongated object, suitably a cylindrical object having a predetermined cylindrical axis such as a pencil, similar to those objects 24 shown in FIG. 2. Extending generally parallel to the first support panel and spaced therefrom is a second support panel 26 having an aperture 28 therethrough, which is also dimensioned to receive and pass therethrough objects such as the pencils 24. Extending from a point adjacent the second support panel aperture 28 to a point proximal an outlet 30 through the lateral side portion 10 is a delivery chute 32. The housing portions, support panels and delivery chute may be formed of any suitable material such as wood, metal or an appropriate synthetic resin.

Supported on the first support panel 20 are hopper means 34, which include side portions 36, 38, 40 and 42 and bottom portion 44. This bottom portion 44 includes an aperture therethrough, defined by bottom portion edges 45, shown most clearly in the side sectional view of FIG. 2, for communicating with the first support panel 20 upon which the hopper is supported.

Operatively connected to the hopper means 34 and extending through the side portion 10 are manual actuating means 46, suitably in the form of a conventional coin operated, elongated slide member. This slide member 46 may include one or more slots 48 for receiving coins to permit movement of the slide only when an appropriate coin or coins are placed thereinto. The actuating means are connected to the hopper means 34 in such a manner that sliding movement of the actuating means 46 will effect corresponding sliding movement of the hopper means 34 in the transverse directions of FIGS. 1 and 2, thus in the horizontal direction of FIG. 2.

Figure 3:
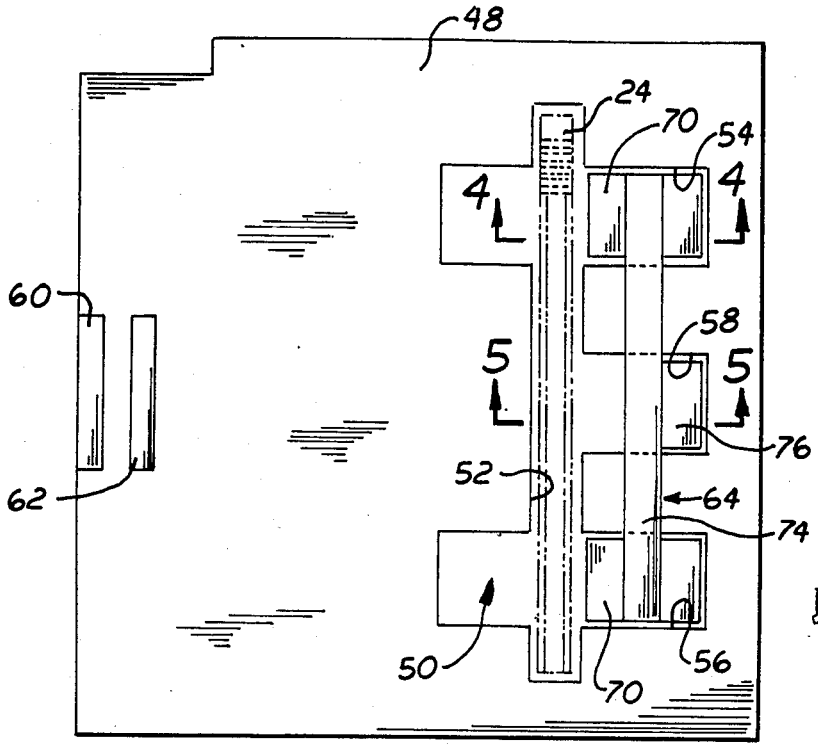
FIG. 3 is a plan view of the slide plate and blocking mechanism of the dispensing apparatus of FIGS. 1 and 2.
Figure 4:
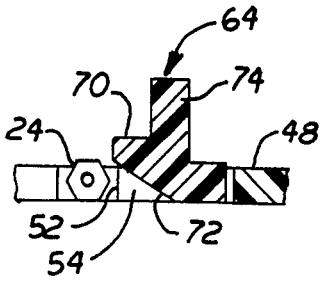
FIG. 4 is a fragmentary side sectional view of the slide plate and blocking mechanism of FIG. 3 taken along line 4—4.

Positioned beneath the first support panel aperture 22 and supported on the second panel 26 are slide plate means 48. Such slide plate means, also shown in the plan view of FIG. 3 include a plate supported on the second support panel for sliding movement thereover in a generally horizontal direction, preferably corresponding to the movement of the hopper means 34 and the actuating means 46. The slide plate means may be fabricated of any convenient material, such as metal, wood or an appropriate synthetic resin and includes an aperture 50 therethrough. This aperture 50 includes an elongated portion 52 extending transverse to the direction of sliding movement of the plate 48 and dimensioned to receive therewithin one unit of the elongated objects 24, such as pencils, to be dispensed. Additionally, the aperture 50 includes one or more enlarged slot portions 54, 56 and 58 adjacent the transverse, object receiving portion 52 and extending in a direction generally parallel to the direction of sliding movement of the plate 48. In the preferred embodiment of the slide plate 48 illustrated in FIG. 3, two of such enlarged longitudinal slot portions 54 and 56 extend across and outwardly on each side of the transverse portion 52, while a third such slot portion 58 extends only to the right hand side, or rear, of the transverse slot 52.

The slide plate 48 is operatively connected to the actuating means 46 for movement with the actuating means. This operative connection may suitably be effected by engagement of the tabs 60 and 62 on the slide plate 48 with a downward extension of the side portion 36 of the hopper means 34, which, in turn, is connected to the actuating means 46, as shown in FIG. 2.

As shown in FIG. 2, blocking apparatus 64 is supported by the housing, suitably resting upon the second support panel 26 with a portion extending upwardly between the downward projection 66 and 68 of first support panel 20. This blocking apparatus 64 is illustrated in more detail in FIGS. 3 through 7. The apparatus 64 suitably comprises at least one and, in this embodiment, two elements 70 to serve as means for sensing the presence or absence of an object 24 to be dispensed in the slide plate aperture 52. This element 70 includes a ramped portion 72 which, in the views of FIG. 2 and FIGS. 4 through 7 slopes downwardly from left to right, generally transverse to the cylindrical axis of the object, or pencil, 24. This ramped portion extends at an angle from a point proximal the lowermost portion of the blocking apparatus 64 to a point spaced above that lowermost point a distance at least equal to the thickness of the object 24, measured transverse to its cylindrical axis. This provides for operation in a manner to be described below.

Connecting the two object sensing elements 70 is connecting bar portion 74. As shown in the side view of FIG. 2 this connecting bar portion 74 preferably is slidably received between the downwardly extending portions 66 and 68 of the first support panel. This reception permits the connecting bar 74, and thus the entire blocking member, to move vertically while restraining transverse movement.

Also attached to connecting bar 74 is the slide plate blocking element 76. This blocking element 76 preferably includes a generally vertical surface 78 for engaging the forward (left hand in the illustrations) surface of the slot 52 if an object is absent from the dispensing slot 52.

The operation of the apparatus described above is generally as follows when actuated by a user desiring to dispense an object, such as a pencil, from the apparatus. The user inserts any necessary coins in the coin slot or slots 48 and pushes the actuating means slide 46 into the apparatus (moving it from left to right in the illustrations). The connection between the actuating means slide 46, the hopper 34 and the slide plate 48 thus cause all of those elements to move from a first position illustrated in FIGS. 1 and 2 toward a second position located to the right of that first position in the illustrations. If there is an object 24, such as a pencil, to be dispensed within the hopper 34 or the aperture 22 in the first support panel, that object 24 will drop through that aperture into the slot 52 in the slide plate, resting upon the second support panel 26. This represents the condition shown in FIGS. 2 and 4. Then, as the actuating slide 46 is moved to the right in the illustrations, the hopper 34 and slide plate 48 likewise will be moved to the right. Because the blocking apparatus 64 is held against any left-right movement by the downward extensions 66 and 68 of the first support panel 20, the blocking apparatus 64 cannot move in that direction, but can move only in the vertical direction between a first position adjacent or resting on the second support panel 26 and a second position spaced above said first position.

As the left hand edge of the slot 52 engages the object 24 and moves it to the right, it will move that object 24 into engagement with the ramped portion 72 of the object sensing elements 70. Continued movement of the slide plate 48 and engagement between the object 24 and the ramped portion 72 of the member 70 will then urge that member 70 and all other portions of the blocking apparatus 64 upwardly to its second position in the manner shown in FIG. 6, thus enabling the object 24 and the slide plate 48 to pass beneath the blocking member. Continued movement of the slide plate from its initial, first position will bring the coin slots of the actuating slide 46 within the housing 2, thus enabling the coins to drop into coin bin 80 (FIG. 2) along with other coins 82. This continued movement ultimately will bring the actuating means 46, hopper 34 and slide plate 48 to their respective second positions in which the slide plate aperture 52 is generally aligned with the aperture 28 in the second support panel. This then permits the object 24 to fall through the aperture 28, slide down the delivery chute 32 for removal by the operator through the aperture 30 in the lateral side portion 10. The actuating slide 46 may then be retracted, moving the slide 46, hopper 34 and slide plate 48 back to their respective first positions. At this point, another object 24 may drop into the slot 52 in the slide plate 48, if there are additional such objects in the dispensing apparatus.

One benefit of the structure of this invention is that the movement of the hopper 34 during the dispensing operation serves to agitate the objects contained within the hopper, thus bringing them into the aperture defined by the edges 45 in the bottom of that hopper 34 so that any such objects present in the hopper would be available for dispensing. The dimensions of this aperture 45 in the bottom portion 44 of the hopper are such that, when the hopper is in its first position, the left hand side of the aperture 46 is adjacent the aperture 22 in the first support panel, while movement of the hopper 34 to its second position will bring the opposite or left hand side of the aperture 46 adjacent that aperture 22 in the support panel 20. This will serve to insure that any object remaining in the hopper will be directed into that support panel aperture 22.

When the supply of objects 24 to be dispensed has been exhausted, it is desirable to prevent actuation of the dispensing apparatus in order to prevent a user from losing his coins into the coin receptacle 80 without receiving a dispensed object in turn. This function is provided by the blocking member 64 in the manner illustrated in FIGS. 5 and 7.

Figure 5:
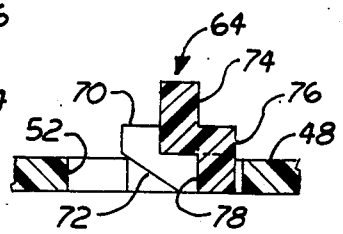
FIG. 5 is a fragmentary side sectional view of the slide plate and blocking mechanism of FIG. 3 taken along line 5—5.
Figure 6:
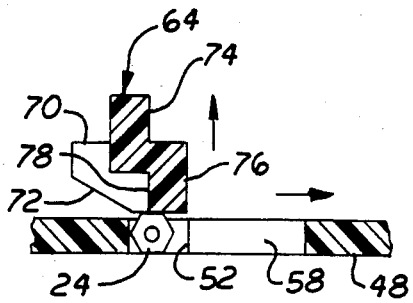
FIG. 6 illustrates the movement of the blocking member of FIG. 5 when an object to be dispensed is present in the slide plate aperture.
Figure 7:
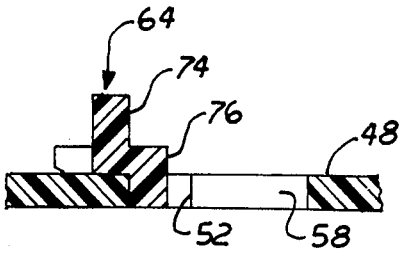
FIG. 7 illustrates the blocking arrangement of the apparatus of FIG. 5 when actuation is attempted with no object present in the slide plate aperture for dispensing.

If there is no object 24 to be dispensed, as shown in FIG. 5, there will be no such object to engage the ramped portion 72 of the sensing element 70 to urge the blocking apparatus 64 upwardly. Thus, the blocking apparatus 64 will remain at its lower position, resting on and engaging the second support panel 26, as shown in FIG. 2. Attempted movement of the actuating slide 46, hopper 34 and slide plate 48 from the first position toward the second position will then result in the situation illustrated in FIG. 7. In this situation the generally vertical surface 78 of the blocking portion will then engage the left side of the object receiving slot 52, as shown in FIG. 7, when the slide plate is moved, the ramped portion 72 of the object sensing element 70 simply sliding into the forward portion of their slots 54 and 56. Such engagement between the surface 78 of the blocking element and the forward portion of the slot 52 in the slide plate 48 thus prevents any further movement of the slide plate, limiting the total movement of the slide plate to a small increment from its first position. Such movement is insufficient to bring the coin slot 48 within the housing, so that the coins cannot drop into the housing and the operator may retract the actuating slide 46 and retrieve his coins.

Figure 8:
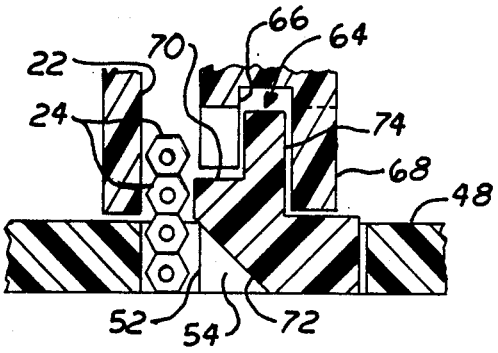
FIG. 8 is a fragmentary view of a portion of FIG. 2 illustrating a modified slide plate and blocking member adapted to provide for dispensing a plurality of pencils with each actuation.

In the fragmentary side sectional view of FIG. 8 is illustrated a modified slide plate 48 and blocking member 72. These modifications comprise, essentially, a doubling of the thickness of the slide plate 48 and increasing the height of the ramped portion 72 of the blocking member 70. By this variation, as illustrated in FIG. 8, a plurality of, in this case 2, pencils 24 are received within the slide plate aperture 52 and carried into alignment with the aperture 28 in the second support panel. In this manner the dispensing apparatus of this invention can be configured to dispense such a plurality of objects, such as pencils, with each actuation of the slide 46. The embodiment illustrated in FIG. 8 provides for a slide plate 48 having a thickness generally equal to the vertical height of two such objects 24 stacked one above the other, with a transverse width of the slot in that illustration being only slightly greater than the width of one such object 24. It is also to be understood that the invention contemplates a slide plate substantially equal in thickness to that of FIGS. 1 through 7 and having an object receiving slot 52 having a transverse width slightly greater than twice the transverse thickness of one such object 24. In this latter configuration the plurality of objects to be dispensed would reside in the slot side by side, instead of one above the other as shown in FIG. 8.

From the foregoing it may be seen that the apparatus of this invention provides a simple yet effective apparatus for dispensing elongated cylindrical objects, such as pencils, while providing for positive blocking of actuation of the dispensing mechanism when the supply of objects to be dispensed has been exhausted. While this detailed description has set forth one particularly preferred embodiment of the apparatus of this invention, numerous modifications and variations of the structure of this invention, all within the scope of the invention, will readily occur to those skilled in the art. Accordingly, it is to be understood that this description is illustrative only of the principles of the invention and is not limitative thereof, the scope of the invention being limited solely by the claims appended hereto.

What is claimed is:

1. Apparatus for dispensing elongated cylindrical objects, such as pencils, each having a predetermined cylindrical axis, said apparatus comprising housing means including lateral side portions a first support panel extending generally horizontally between said lateral side portions and having an aperture therethrough dimensioned to receive and pass therethrough a single said object;

a second support panel positioned below said first support panel and extending generally parallel to said first support panel and having an aperture therethrough dimensioned to receive and pass therethrough said objects; and a delivery chute extending from adjacent said second support panel aperture to outlet means through at least one of said lateral side portions;

hopper means enclosed within said housing means and supported upon said first support panel for horizontal sliding movement between a first position and a second position, said hopper means including side portions and a bottom portion with said bottom portion having an aperture therethrough for communicating with said first support panel aperture;

manual actuating means extending through at least one of said lateral side portions and comprising an elongated member having one end thereof adapted for grasping and movement by a user of the dispensing apparatus and the other end thereof operatively connected to said hopper means for sliding movement thereof in a predetermined horizontal direction;

slide plate means having an aperture therethrough which has an object receiving portion for receiving at least one said object to be dispensed, said slide plate means being supported upon said second support panel for horizontal movement thereover in said predetermined horizontal direction between a first position in which said slide plate aperture is generally aligned with said first support panel aperture for receiving said object therefrom and a second position in which said slide plate aperture is generally aligned with said second support panel aperture, said slide plate being operatively connected to said actuating means for movement with said actuating means; and blocking apparatus supported by said housing means and including means for sensing the presence or absence of said object to be dispensed in said slide plate aperture and permitting said movement of said slide plate from said first position to said second position if said object is present in said slide plate aperture but blocking said movement of said slide plate from said first position to said second position if said object is absent, whereby the slide plate, the hopper and the actuating means may be moved from their respective first positions to their second positions only if an object to be dispensed is present in the slide plate aperture when the slide plate is positioned at the first position.

2. The dispensing apparatus of claim 1 wherein said blocking apparatus is movable between a first position and a second position spaced above said first position and wherein said blocking apparatus includes a member positioned to engage and block said movement of said slide plate to said slide plate second position when said blocking apparatus is in said first position and to permit said slide plate to pass thereby when said blocking apparatus is in said second position.

3. The dispensing apparatus of claim 2 wherein said slide plate aperture includes an enlarged portion adjacent said object receiving portion with said blocking apparatus received within said aperture enlarged portion when said slide plate is in said first position.

4. The dispensing apparatus of claim 3 wherein said blocking apparatus object sensing means comprises a ramped portion of said blocking apparatus extending in a direction generally transverse to said object cylindrical axis and extending at an angle from a point proximal the lowermost portion of said blocking apparatus to a point spaced above said lowermost point at least a distance equal to the thickness of said object transverse to said axis, whereby engagement of the ramped portion with an object received in the slide plate as the slide plate is moved from its first position toward its second position will serve to urge the blocking apparatus upwardly.

5. The dispensing apparatus of claim 3 wherein said slide plate aperture is dimensioned to receive therewithin a plurality of said objects to be dispensed and said blocking apparatus object sensing means comprises a ramped portion of said blocking apparatus extending in a direction generally transverse to said object cylindrical axis and extending at an angle from a point proximal the lowermost portion of said blocking apparatus to a point spaced above said lowermost point at least a distance equal to the total vertical height of said objects above said second support panel, whereby engagement of the ramped portion with objects received within the slide plate as the slide plate is moved from its first position toward its second position will serve to urge the blocking apparatus upwardly.

* * * * *